United States Patent [19]

Rodi et al.

[11] Patent Number: 4,729,312

[45] Date of Patent: Mar. 8, 1988

[54] INK DUCT FOR OFFSET OR LETTERPRESS PRINTING MACHINES

[75] Inventors: Anton Rodi, Leimen; Peter T. Blaser, Dielheim; Walter Hofheinz, Heidelberg, all of Fed. Rep. of Germany

[73] Assignee: Heidelberger Druckmaschinen AG, Heidelberg, Fed. Rep. of Germany

[21] Appl. No.: 924,201

[22] Filed: Oct. 28, 1986

[30] Foreign Application Priority Data

Oct. 28, 1985 [DE] Fed. Rep. of Germany ..... 3538256

[51] Int. Cl.[4] ..... B41F 31/00

[52] U.S. Cl. ..... 101/350; 101/365

[58] Field of Search ..... 101/364, 365, 350, 331

[56] References Cited

U.S. PATENT DOCUMENTS

| | | | |
|---|---|---|---|
| 3,100,560 | 8/1963 | Kondur, Jr. | 400/216.1 X |
| 4,242,958 | 1/1981 | Jeschke | 101/365 |
| 4,387,648 | 6/1983 | Jeschke et al. | 101/365 |
| 4,442,775 | 4/1984 | Jentzsch | 101/365 |
| 4,480,547 | 11/1984 | Jeschke et al. | 101/365 X |
| 4,495,864 | 1/1985 | Junghans | 101/365 |

*Primary Examiner*—Edgar S. Burr
*Assistant Examiner*—Joseph McCarthy
*Attorney, Agent, or Firm*—Herbert L. Lerner; Laurence A. Greenberg

[57] ABSTRACT

Ink duct for offset or letterpress printing machines has an ink metering device by which a respective ink gap is adjustable zonewise in the axial direction of an ink duct roller. The ink metering device has metering elements pressable against the ink duct roller through the intermediary of a foil covering the metering elements, the foil being fastened so as to be movable tangentially to the ink duct roller. A device is provided for holding the foil, and an adjusting device is coupled with a motorized drive an engageable with the foil holding device for progressively moving the foil tangentially to the ink duct roller at a substantially uniform feed rate so as to dispose succeeding locations of the foil at a given distance from the ink duct roller corresponding to the width of the respective ink gap.

12 Claims, 4 Drawing Figures

INK DUCT FOR OFFSET OR LETTERPRESS PRINTING MACHINES

The invention relates to an ink duct for offset or letterpress printing machines and, more particularly, to such an ink duct having an ink metering device by means of which a respective ink gap is adjustable zonewise in the axial direction of the ink duct roller, metering elements of the ink metering device being pressable against the ink duct roller under spring pressure through the intermediary of an elastic foil covering the metering elements, the elastic foil being fastened so as to be movable tangentially to the ink duct roller.

An elastic foil used as described hereinbefore serves the primary purpose of preventing the ink in the ink fountain from soiling the ink metering device or the adjusting mechanisms thereof. Due to its elasticity it can adapt itself to the respective setting of a metering element to permit a more-or-less large gap to be formed with respect to the ink duct roller, thus allowing the quantity of ink metered thereby to pass. Because the metering elements are supported on the rotating ink duct roller through the intermediary of the elastic foil, however, this supporting location of the foil is subject to a given degree of wear. In the course of time, the foil is abraded at the respective locations and consequently becomes thinner which, in turn, has such an influence upon the ink metering as to reduce any assurance of a constant ink gap width over the long run. Today, however, with the generally offered remote control in printing machines, an ink gap of constant width is desirable.

A proposal for extending the service life of such a foil is described in U.S. Pat. No. 4,344,360. This patent discloses, in the upper part of an ink duct, holding or retaining devices to which an elastic foil is fastened and via which the foil can be manually moved stepwise tangentially to the ink duct roller so that, after having been moved, a new, unused part of the foil surface is in contact with the ink duct roller.

In this manner, the service life of the foil can be extended, and additional work, e.g. changing the foil, does not have to be done as frequently any more. This aforementioned proposal, however, exhibits disadvantages which stand in the way of an optimal ink metering. Thus, the stepwise shifting of the foil also always requires an adjustment of the ink gap from a heavily used region to a non-used region. Consequently, uniform wear is not assured. Moreover, in practice, it is incumbent on the operator to decide in accordance with his own judgment at what time intervals the elastic foil has to be changed or when it has to be moved.

It is, accordingly, an object of the invention to provide an ink duct for offset or letterpress printing machines having an ink metering device covered by an elastic foil, the service life of which can be extended even more and, because of uniform and very little wear, a constant width of the ink gap is attainable so that compensating adjustment of the ink metering device is dispensed with.

With the foregoing and other objects in view, there is provided in accordance with the invention, an ink duct for offset or letterpress printing machines having an ink metering device by means of which a respective ink gap is adjustable zonewise in the axial direction of an ink duct roller, the ink metering device having metering elements pressable against the ink duct roller through the intermediary of a foil covering the metering elements, the foil being fastened so as to be movable tangentially to the ink duct roller, comprising means for holding the foil, adjusting means coupled with a motorized drive and engageable with the foil holding means for continuously moving the foil tangentially to the ink duct roller at a small feed rate.

In accordance with another feature of the invention, the motorized drive is formed of a motor transmission unit having a very low driven speed.

In accordance with a further feature of the invention, there is provided an ink duct for offset or letterpress printing machines having an ink metering device by means of which a respective ink gap is adjustable zonewise in the axial direction of an ink duct roller, the ink metering device having metering elements pressable against the ink duct roller through the intermediary of a foil covering the metering elements, the foil being fastened so as to be movable tangentially to the ink duct roller, comprising a respective adjusting lever at each of two ends of the ink duct, the adjusting lever being pivotable about a pivot axis, a traverse connecting both of the adjusting levers to one another a respective threaded part articulatingly connected to a lower end of each of the adjusting levers, the threaded part, respectively, co-operating with a threaded rod of a motor/-transmission unit, the adjusting lever acting upon the foil via the traverse.

In accordance with an additional feature of the invention, the the foil is fastened to a base plate of the ink duct in an upper region of the ink duct.

In accordance with an added feature of the invention, the foil is directly fastened to the traverse.

In accordance with yet another feature of the invention, there is provided an ink duct for offset or letterpress printing machines having an ink metering device by means of which a respective ink gap is adjustable zonewise in the axial direction of an ink duct roller, the ink metering device having metering elements pressable against the ink duct roller through the intermediary of a foil covering the metering elements, the foil being fastened so as to be movable tangentially to the ink duct roller, comprising a foil supply reel disposed in a lower part of the ink duct and a reel for winding up the foil in an upper part of the ink duct, the wind-up reel extending over the entire length of the ink duct, and a gearwheel drive with a motor/transmission unit connected thereto engaging with the wind-up reel.

In accordance with yet a further feature of the invention, there are provided acoustic signal transmitter means for indicating the end of the foil supply.

In accordance with yet an additional feature of the invention, there are provided optical signal transmitter means for indicating the end of the foil supply.

In accordance with yet an added feature of the invention, there are provided signal transmitter means for indicating the end of the foil supply, the signal transmitter means being integral with the adjusting means.

In accordance with an alternate feature of the invention, there are provided signal transmitter means for indicating the end of the foil supply, the signal transmitter means being integral with the foil supply reel.

In accordance with a further aspect of the invention, there are provided signal transmitter means for indicating the end of the foil supply, the signal transmitter means being connected to the adjusting means.

In accordance with a concomitant feature of the invention, there are provided signal transmitter means for indicating the end of the foil supply, the signal transmitter means being connected to the foil supply reel.

A considerable advantage of the inventive construction is that optimum adjusting conditions are provided for a remote-controllable ink metering device, the conditions being constant over quite a long period of time. In all of the embodiments of the invention, the continuous movement of the foil also removes dirt particles which might possibly accummulate in the ink metering gap.

Other features which are considered as characteristic for the invention are set forth in the appended claims.

Although the invention is illustrated and described herein as embodied in an ink duct offset or letterpress printing machines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
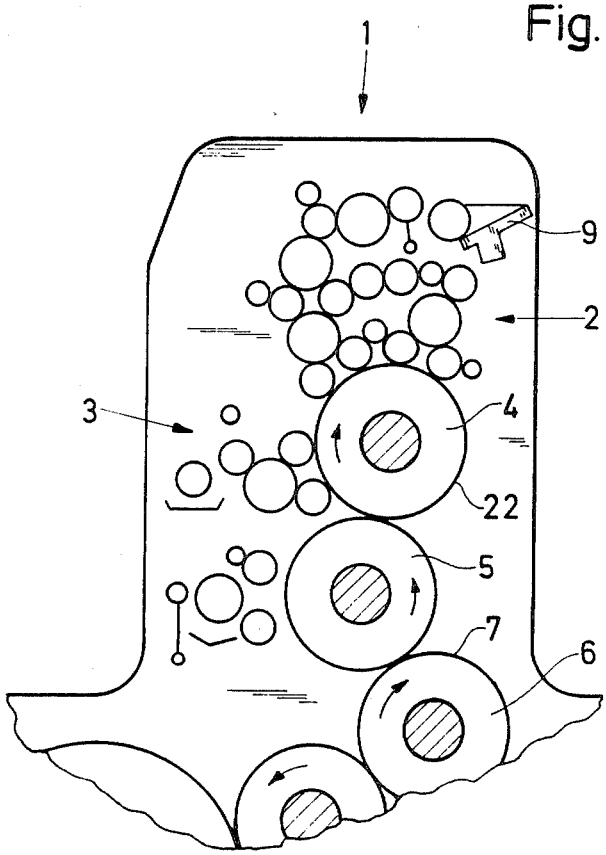
FIG. 1 is a diagrammatic side elevational view of a printing unit of a sheet-fed rotary offset printing machine having an ink fountain or duct constructed in accordance with the invention.

Referring now to the drawing and first, particularly to FIG. 1 thereof, there is shown, in the interest of simplicity, only one printing unit 1 of a sheet-fed rotary offset printing machine. The printing plate 22 on a plate cylinder 4 is inked by an inking unit 2 and dampened by a dampening unit 3 so that the printing image can be applied via a blanket cylinder 5 onto a sheet of paper 7 fed between the blanket cylinder 5 and an impression cylinder 6 which is engaged with the latter. Because the amount of fresh ink which is required, for example, over the width of the sheet of paper 7, varies in accordance with the printing image, the amount of ink is metered zonewise by means of an ink metering device 8 of an ink fountain or duct 9.

The ink metering device in essence includes a number of zone-wide pressure bars 10 arranged adjacent one another in longitudinal direction of the ink duct 9 and having mounted on the front end of each thereof, a respective, likewise zone-wide metering element 11. Each metering element 11 is rotatable about its longitudinal axis by means of an otherwise non-illustrated adjusting mechanism and, moreover, at a given region of the circumference thereof is formed with an eccentric recess 13 extending almost over the entire zone width. The metering element 11 is braced against an ink duct roller 15 via remaining narrow end supporting portions 14 having the full circumference of the metering element 11, the bracing force being derived from the spring force of a compression spring 16 acting upon the pressure bar 10. All of the pressure bars 10 and the metering elements 11 are covered by an elastic foil 17 extending over the entire length of the ink duct 9, thereby preventing the printing ink 18 in the ink duct 9 from soiling the ink metering device 8. More details of the construction and operation of the ink metering device may be obtained, for example, from U.S. Pat. Nos. 4,242,958 and 4,453,467.

The elastic foil 17 is subject to a given degree of wear at the contact location 19 between the narrow supporting portions 14 and the rotating ink duct roller 15.

Figure 2:
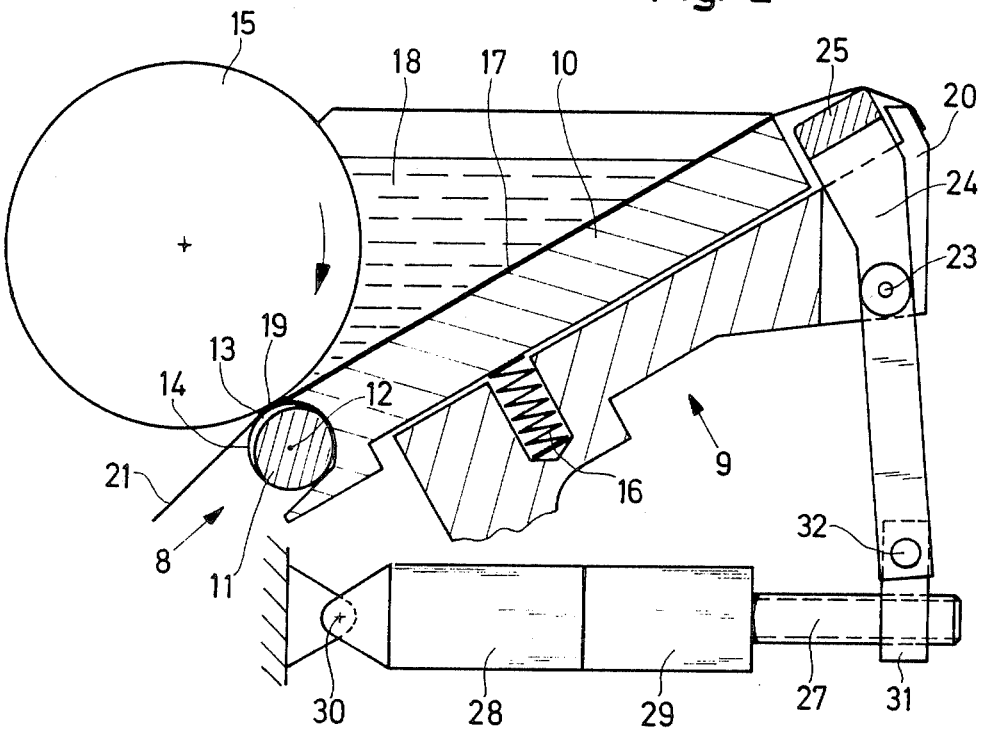
FIG. 2 is an enlarged fragmentary view of FIG. 1 showint the ink duct with an ink metering device having an adjusting lever acting on an elastic foil thereof.

According to the invention, the elastic foil 17 is fastened to a base plate 20 of the ink duct 9 in an upper part of the ink duct 9. At each of the two front or end sides of the ink duct 9, only one of the sides or ends being shown in FIG. 2, there is provided an adjusting lever 24 rotatable about pivot shaft or axis 23, both adjusting levers 24, only one of which is shown, being linked to one another by a traverse 25. By means of an articulation 32, an internally threaded piece 31 into which a threaded rod 27 of a motor/transmission unit 28, 29 is screwed is connected to the lower end of each of the adjusting levers 24, this motor/transmitter unti 28, 29 being fastened to a stationary articulating or pivot point 30. Due to an extremely great speed reduction by means of the transmission 29 and due to corresponding lever-arm relationships, a continuous shifting movement (feed) of the elastic foil 17 tangentially to the ink duct roller 15 can be achieved. The end of the foil 21 projecting beyond the contact location 19 serves as the supply of foil.

Figure 3:
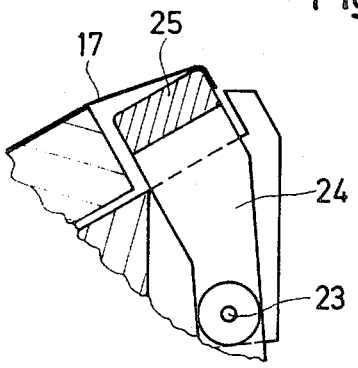
FIG. 3 is a fragmentary view of FIG. 2, showing a modification of the adjusting lever which affords a greater degree of adjustment.

In the embodiment according to FIG. 3, the elastic foil 17 is held directly by the traverse 25 or is attached thereto, e.g. by gluing or clamping, thereby ensuring greater clearance for play or movement of the adjusting lever 24 and thus a greater degree of adjustment.

Figure 4:
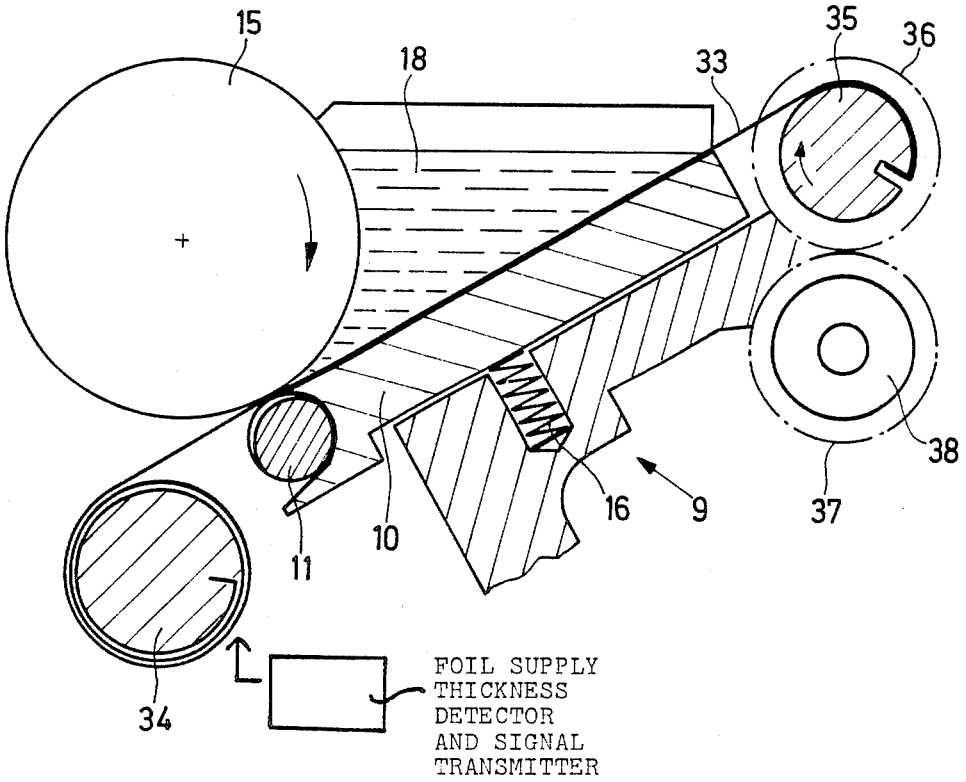
FIG. 4 is a diagrammatic side elevational view of another embodiment of the ink duct with a device for achieving an extremely long service life of the elastic foil.

FIG. 4 shows another embodiment of the invention which permits an extremely long service life of the elastic foil 33 which, for this purpose, is unwound from a supply reel 34 in the lower part of the ink duct 9 and wound onto a reel 35 arranged in the upper part of the ink duct 9 and extending over the entire length thereof. At one end of the elongated reel 35, there is provided a gearwheel 36 cooperating with another gearwheel 37, the rotary movement of which is derived from an otherwise non-illustrated motor/gear unit. In this case, too, the transmission is constructed so as to achieve an extreme reduction of the motor speed, so that the shifting moving (feed) of the elastic foil 33 is adjustable to the required extent according to the permissible wear. Through different dimensioning of the gearwheels, the reduction ratio could be influenced additionally.

The invention is not limited to the illustrated embodiments because it is conceivable to have other drive and transmission mechanisms act upon the elastic foil, without major constructive expense in order to attain the desired effect, whereby the elasticity of the foil in the direction of motion thereof can also be diminished.

It is also conceivable to indicate the approaching end of the foil 17, 33 by means of correspondingly integrated or connected acoustic or optical signal transmitters which, for example, detect the setting of the adjusting lever 24 or the thickness of the foil supply on the supply reel 34, so that the foil can be changed in time.

We claim:

1. Ink duct for offset or letterpress printing machines having an ink metering device including an ink duct roller and ink metering elements by means of which a respective ink gap is adjustable zonewise in axial direction of said ink duct roller, the ink metering device having a foil covering the metering elements with the metering elements pressable against the ink duct roller through the intermediary of said foil, said foil being fastened so as to be movable tangentially to the ink duct roller, comprising means for holding a location of the foil at a given distance from the ink duct roller corresponding to the width of the respective ink gap, and adjusting means coupled with a motorized drive and engageable with said foil holding means for progressively moving the foil tangentially to the ink duct roller at a substantially uniform feed rate so as to dispose succeeding locations of the foil at said given distance from the ink duct roller.

2. Ink duct according to claim 1, wherein said motorized drive is formed of a motor and transmission unit.

3. Ink duct for offset or letterpress printing machines having an ink metering device including an ink duct roller and ink metering elements by means of which a respective ink gap is adjustable zonewise in the axial direction of said ink duct roller, the ink metering device having a foil covering the metering elements with the metering elements pressable against the ink duct roller through the intermediary of said foil, said foil being fastened so as to be movable tangentially to the ink duct roller, comprising a respective adjusting lever at each of two ends of the ink duct, said adjusting lever being pivotable about a pivot axis, a traverse connecting both of the adjusting levers to one another, a respective threaded part articulatingly connected to a lower end of each of said adjusting levers, said threaded part, respectively, co-operating with a threaded rod of a motor and transmission unit, said adjusting lever acting upon the foil via said traverse for progressively moving the foil tangentially to the ink duct roller at a substantially uniform feed rate so as to dispose succeeding locations of the foil at a given distance from the ink duct roller corresponding to the width of the respective ink gap.

4. Ink duct according to claim 3, wherein the foil is fastened to a base plate of the ink duct in an upper region of the ink duct.

5. Ink duct according to claim 3, wherein the foil is directly fastened to said traverse.

6. Ink duct for offset or letterpress printing machines having an ink metering device including an ink duct roller and ink metering elements by means of which a respective ink gap is adjustable zonewise in the axial direction of said ink duct roller, the ink metering device having a foil covering the metering elements with the metering elements pressable against the ink duct roller through the intermediary of said foil, said foil being fastened so as to be movable tangentially to the ink duct roller, comprising a foil supply reel disposed in a lower part of the ink duct and a reel for winding up the foil in an upper part of the ink duct, said wind-up reel extending over the entire length of the ink duct, and a gearwheel drive with a motor/transmission unit connected thereto engaging with said wind-up reel for progressively moving the foil tangentially to the ink duct roller at a substantially uniform feed rate so as to dispose succeeding locations of the foil at a given distance from the ink duct roller corresponding to the width of the respective ink gap.

7. Ink duct according to claim 1, including acoustic signal transmitter means for indicating the end of the foil supply.

8. Ink duct according to claim 1, including optical signal transmitter means for indicating the end of the foil supply.

9. Ink duct according to claim 1, including signal transmitter means for indicating the end of the foil supply, said signal transmitter means being integral with said adjusting means.

10. Ink duct according to claim 6, including signal transmitter means for indicating the end of the foil supply, said signal transmitter means being integral with said foil supply reel.

11. Ink duct according to claim 1, including signal transmitter means for indicating the end of the foil supply, said signal transmitter means being connected to said adjusting means.

12. Ink duct according to claim 6, including signal transmitter means for indicating the end of the foil supply, said signal transmitter means being connected to said foil supply reel.

* * * * *